US006796558B1

(12) United States Patent
Dorer

(10) Patent No.: US 6,796,558 B1
(45) Date of Patent: Sep. 28, 2004

(54) SHEET COLLECTOR WITH NEXT STACK STOP

(75) Inventor: Wilfried Dorer, Donaueschingen (DE)

(73) Assignee: Mathias Bäuerle GmbH, St. Georgen (DE)

( * ) Notice: Subject to any disclaimer, the term of this patent is extended or adjusted under 35 U.S.C. 154(b) by 200 days.

(21) Appl. No.: 09/663,470

(22) Filed: Sep. 15, 2000

(30) Foreign Application Priority Data

Sep. 15, 1999 (DE) ..... 199 44 166

(51) Int. Cl.[7] ..... B65H 31/26

(52) U.S. Cl. ..... 271/189; 271/207; 271/3.03; 271/3.14; 271/265.01; 270/58.01

(58) Field of Search ..... 271/207–213, 271/223, 189–198, 199, 272, 275, 3.14, 3.03, 265.01; 270/58.01, 52.01, 52.02; 414/789.9–790.8

(56) References Cited

U.S. PATENT DOCUMENTS 4,436,472 A * 3/1984 Kunzmann ..... 271/183
4,647,265 A * 3/1987 Uno ..... 271/189
4,799,663 A * 1/1989 Golicz ..... 271/199
4,802,665 A * 2/1989 Allio et al. ..... 271/225
5,147,092 A * 9/1992 Driscoll et al. ..... 271/184
5,244,200 A * 9/1993 Manzke ..... 271/198
5,364,085 A * 11/1994 Kennish ..... 270/58.01
5,375,825 A * 12/1994 Kennish ..... 270/58.01

* cited by examiner

*Primary Examiner*—Patrick Mackey
(74) *Attorney, Agent, or Firm*—Gudrun E. Huckett

(57) ABSTRACT

In a method for transporting sheets of paper the individual sheets are conveyed successively in a conveying direction to a stop unit and at least one sheet is held at the stop unit to form a set at the stop unit. The stop unit is activated for conveying the set formed at the stop unit when a sheet of a next set to be formed at the stop unit overlaps the set formed at the stop unit. The device for performing the method has a collector with transport elements for transporting sheets along a transport path and a stop unit positioned in the transport path and operated intermittently for forming sets of sheets and further transporting the sets formed thereat. A control device is connected to the stop unit. The collector further has a first sensor device connected to the control device which sends an activation signal to the stop unit when a sheet of a next set to be formed overlaps a set already formed at the stop unit.

24 Claims, 3 Drawing Sheets

SHEET COLLECTOR WITH NEXT STACK STOP

BACKGROUND OF THE INVENTION

1. Field of the Invention

The invention relates to a method for transporting sheets which are conveyed successively to a stop unit and are held there until a stack is formed which is comprised of at least one sheet which stack is subsequently transported farther by the stop unit. The invention also relates to a device for performing the method, wherein the device comprises transport elements, preferably transport belts, for the sheets, and a stop unit which is positioned in the transport path of the sheets and can be driven in a cycled fashion and is connected to a control device.

2. Description of the Related Art

In a known device of this kind, the sheets are supplied by a feeder. In the feeder, the sheets are stacked and are then individually gripped by rollers and read. The sheets are transported by the transport elements to the stop unit where they are held until the sheets coming from the feeder stack have been compiled as sets. As soon as these sheet sets or sheet stacks have been generated, the stop unit is switched on so that this set of sheets is transported to a processing station arranged downstream. When switching on the stop unit, the feeder is also switched on so that the sheets of the next set to be formed are transported to the stop unit. As soon as the previously formed stack has been transported away, the stop unit is switched off so that the subsequently arriving sheets coming from the feeder again can form a stack at the stop unit. In this way, the corresponding sheet sets at the stop unit are formed successively and are then transported in a cycled fashion. The sheet sets are formed with considerable temporal spacing successively at the stop unit and then further transported by it. With this procedure and device it is therefore not possible to achieve high output.

SUMMARY OF THE INVENTION

It is an object of the present invention to further develop the method according to the aforementioned kind such that a high output can be achieved without compromising the reliability of the sheet feeding action.

In accordance with the present invention, this is achieved in that the further transport of the sheet stack is carried out as soon as a sheet of the next stack to be formed overlaps the sheet stack resting against the stop unit. With respect to the device this is achieved in that the control device has a sensor device connected thereto which during transport of a sheet, belonging to the stack to be newly formed, sends a signal for switching on the stop unit when the transported sheet overlaps the stack resting against the stop unit.

In the method according to the invention the further transport of the stack formed at the stop unit and the feeding of the sheet of the next stack to be formed are carried out so that overlap occurs. Accordingly, during the stack formation there is no delay, resulting from the wait for the finished stack to be transported farther by the stop unit, before the first sheet of the next stack to be formed is supplied. The further transport of the stack formed at the stop unit is carried out as soon as the first sheet of the respective next stack to be formed overlaps the stack resting against the stop unit. In this way, very high cycle times and thus very high output is produced. The device according to the invention has a sensor device which, during the transport of the sheet belonging to the next stack to be formed, supplies a signal for switching on the stop unit when this sheet overlaps the finished stack resting against the stop unit. Because of this embodiment the device according to the invention has a high output.

In the simplest case, the stack (set) is comprised of only a single sheet. Of course, the stack can also be comprised of two or more sheets.

DESCRIPTION OF THE PREFERRED EMBODIMENTS

Figure 1:
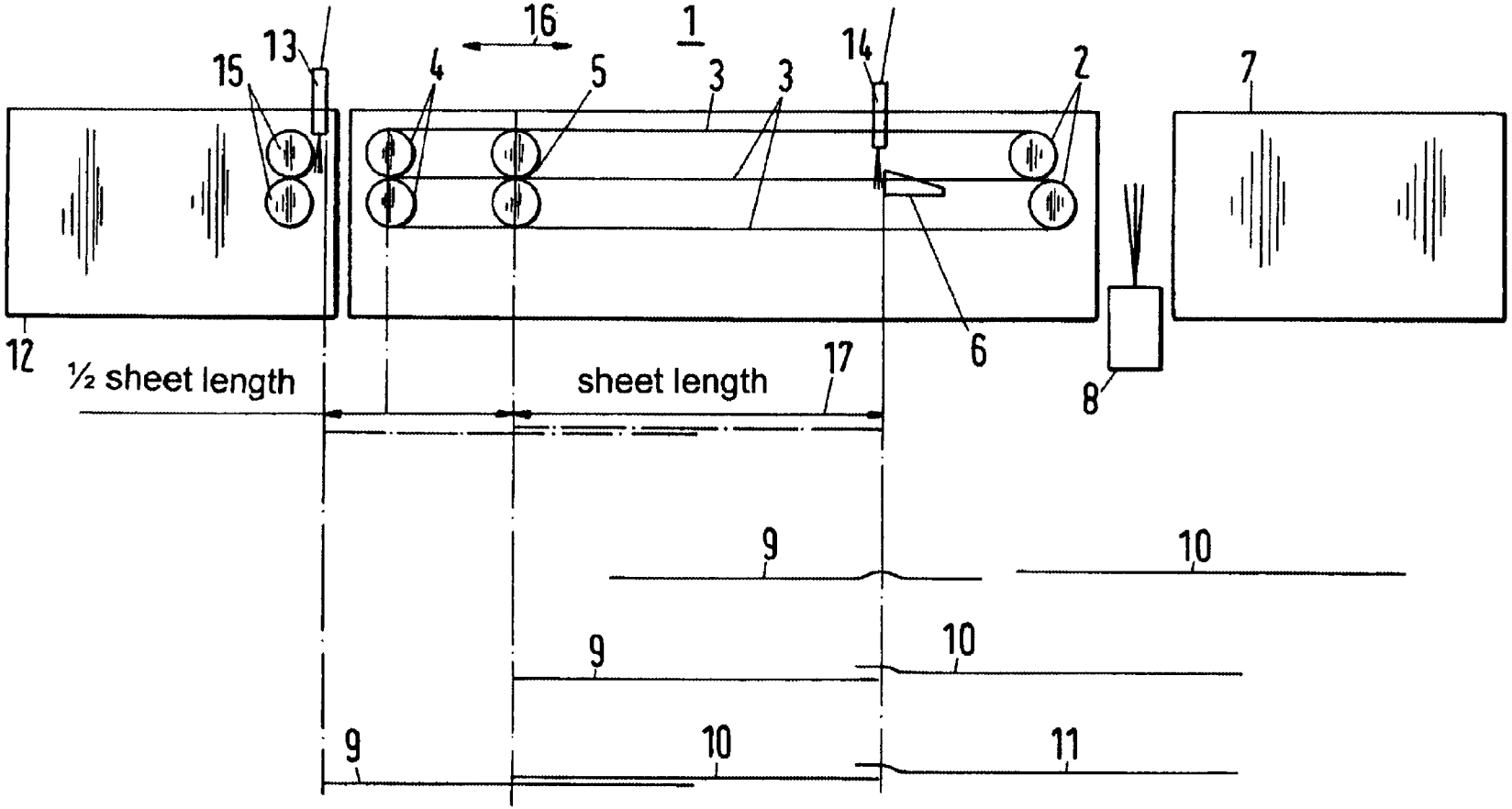
FIG. 1 is a schematic representation of the sequence of method steps when using the device according to the invention.

The device serves to collect individually fed documents to form sets and the sets of sheets are subsequently transported farther to an after processing station. In FIG. 1 the steps of the method sequence are schematically illustrated. The device 1 is a collector which at its intake side has two shafts 2 positioned above one another about which transport belts 3 are guided, respectively. With these transport belts, the documents such as sheets are transported through the collector 1. At the exit side the collector is provided with shafts 4 positioned above one another about which the transport belts 3 are guided. In the area between the shafts 2 and 4, a stop unit 5 is provided which in the shown embodiment is comprised of rollers arranged above one another and rotating in opposite directions. Advantageously, this stop unit 5 is adjustable in the transport direction of the sheets so that the collector 1 can be adjusted to different sheet sizes.

In the transport direction a ramp 6 is provided downstream of the shafts 2 which ensures that the sheet coming from the supply system 7 is lifted. The sheets run onto the slanted side of the ramp 6 and are thus lifted in this area. Such ramps 6 are known in connection with such collectors 1 and will therefore not be described in detail in this context. At least one reading system 8 is correlated with the supply system 7 with which the individual sheets, before being fed to the collector 1, are read. The reading system 8 of the illustrated embodiment is arranged in the area between the supply system 7 and the collector 1. The reading system 8 detects the individual sheets and ensures that those sheets that belong to a set are compiled and formed into a stack. In the simplest case, the stack or set is comprised of only a single sheet. However, it is possible to combine two or more sheets to a set or stack. The supply system 7 can, for example, be a feeder.

At the beginning of the collecting process a first sheet 9 is transported via the transport belts 3 from the supply system 7 until it reaches with its leading edge in the transport direction the stop unit 5. The rollers of the stop unit 5 are standing still so that the sheet 9 remains in this stop position until the subsequent sheet 10 is supplied. In FIG. 1 a scenario is illustrated in which each set is comprised of only a single sheet. In FIG. 1 three positions of the sheets 9 passing through the collector 1 are illustrated. In the middle position, the sheet 9 rests with its leading edge in the transport direction at the stop unit 5. The next sheet 10, which in this embodiment belongs to the next set, is being transported by the supply system 7 via the transport elements into the collector 1. Via the ramp 6 the leading edge of the sheet 10 is lifted in the transport direction such that it can overlap the sheet 9 resting against the stop unit 5. As soon as overlap has occurred, the rollers are driven such by the stop unit 5 that the sheet 9 is transported in the direction toward the after processing station 12. Preferably, the following sheet 10 is transported with the same speed as the sheet 9. As soon as the leading edge of the next sheet 10 comes to rest against the stop unit 5 in the transport direction, the rollers of the stop unit 5 are stopped. This makes it possible that the first sheet 9 is transported with a portion of its length in the direction toward the after processing unit 12 and that the successively supplied sheet 10 remains in the stop position (lower representation of FIG. 1). At this point, in the manner disclosed above, the next sheet 11 is supplied by the supply system 7. It is again read by the reading system 8 and moved into the collector 1. Its leading edge also reaches the ramp 6 so that the edge of this sheet 11 is lifted. As soon as the sheet 11 overlaps the sheet 10, the drive of the rollers of the stop unit 5 is again started. This causes the sheet 9, which is still positioned between the rollers of the stop unit 5, to be completely transported out of the collector 1 while the sheet 10 is transported farther until the sheet 11 comes to rest against the rollers of the stop unit 5. At this point, the stop unit 5 is switched off again. In this way, the individual sheets are transported through the collector 1 in sequence.

Because of the described method, the supply system 7 must not be switched off but can be operated continuously. This results in extremely short time periods for the sheets 9 to 11 to pass through the collector 1. The collector 1 has a very high output because of this process sequence.

In order to obtain an optimal passage time of the sheets 9 to 11 through the collector 1, they are each transported after their contact at the stop unit 5 by half their length, respectively.

The switching off of the stop unit 5 is carried out when the leading edge of the respective sheets 9 to 11 in the transport direction reaches the photoelectric barrier 13 which is advantageously provided at the after processing unit 12. As soon as one of the sheets 9 to 11 has reached with its leading edge the light barrier or photo electric barrier 13, the latter sends a switch-off signal to the stop unit 5 so that its rollers are then stopped.

In the same way, the rollers of the stop unit 5 are switched on when the sheets 9 to 11 supplied by the supply system 7 reach the ramp 6 and overlap the sheet stack by a certain amount. The collector 1 is provided with a photoelectric barrier 14 for this purpose which in the illustrated embodiment is positioned immediately behind the ramp 6 in the transport direction of the sheets. As soon as the respective following sheet 10, 11 has overlapped the respective sheet 9, 10 in front, the photoelectric barrier 14 sends a corresponding signal to the stop unit 5 which is thus switched on.

The after processing unit 12 is provided at the intake side with a transport device 15 which is, for example, formed by rollers positioned atop one another. This transport device 15 can be driven continuously since the respective sheets 9 to 11 are stopped by means of the light barrier 13 shortly before reaching the transport device 15.

Before the collecting process is started, the position of the stop unit 5 relative to the light barrier 13 or to the shafts 4 is adjusted to the size of the sheets 9 to 11 to be transported. When the paper size changes, the stop unit 5 is adjusted in the direction of the double arrow 16 in FIG. 1 such that the sheets come to rest between the ramp 6 and the stop unit 5. The spacing 17 between the axes of the rollers of the stop unit 5 and the ramp corresponds to the length of the sheets 9 to 11 to be transported. Also, the ramps 6 are adjusted accordingly in the transport direction of the sheets 9 to 11. When, for example, in the shown embodiment a shorter sheet size is to be processed, the spacing between the stop unit 5 and the shafts 4 at the exit side of the collector 1 must be shortened. Accordingly, the ramp 6 must also be horizontally adjusted in the direction toward the shafts 4. When, on the other hand, longer sheet sizes are used, the stop unit 5 and the ramp 6 are adjusted in the other direction.

The collector 1 operates fully automatically. The reading system 8, the rollers of the stop unit 5, the shafts 2, 4, and the corresponding photoelectric barriers 13 and 14 are connected to the control device. The control device comprises at least one micro controller which can be provided in the supply system 7, in the collector 1, or in the after processing unit 12.

The supply system 7 can have any suitable configuration. Also, the after processing unit 12 can be any suitable device, for example, a folding machine, a packaging machine, which may be a part of an inserter, a stapling device, a welding device etc. The sheets 9 to 11 transported through the collector 1 can thus be further processed in different ways.

In FIG. 1, for reasons of simplifying the drawings, it is surmised that each set is comprised of a single sheet 9 or 10 or 11. For sets which are comprised of several sheets, which may be identical or different, the individual sheets are stacked at the stop unit 5 to form the respective set. The stop unit is not switched on during this collecting period. Only when the respective set has been formed at the stop unit 5 and the first sheet of the next set overlaps the already stacked set, the stop unit 5 is switched on as disclosed above. With this intermittent operation of the stop unit 5, the respective sets are formed sequentially at the stop unit 5 and individual sets are then supplied in the manner described above to the after processing unit 12. The reading system 8 detects when a sheet of the next stack is supplied and a sensor signal is then sent to the stop unit 5.

With the aid of FIGS. 2 and 3, the collector 1 will be explained in more detail. It has a frame 18 in which a motor 19 is arranged. Its drive shaft 20 is in driving connection by means of an endless drive 21 with an intermediate shaft 22 which is rotatably supported in the sidewalls 23, 24 (FIG. 3) of the frame 18. As is illustrated in FIG. 3, a pulley 25 is provided on the end of the intermediate shaft 22 projecting from the sidewall 23 and the endless drive member 21 (FIG. 2) is guided about this pulley 25. The end of the intermediate shaft 22 projecting past the sidewall 24 of the frame 18 supports a pulley 26 about which the endless belt 27 is guided. The endless belt 27 connects the intermediate shaft 22 with the shaft 28 and the shafts 2. The ends of the shafts 2, 28 are rotatably supported in the sidewalls 23, 24 of the frame 18. The required tension of the endless belt 27 is provided by two tension rollers 29, 30 which are rotatably supported on the external side of the sidewall 24. In FIG. 3, for reasons of simplification, only one tension roller 30 is illustrated which is positioned adjacent to the upper shaft 2. The tension roller 29, as illustrated in FIG. 2, is positioned immediately adjacent to the shafts 2, 28.

Figure 2:
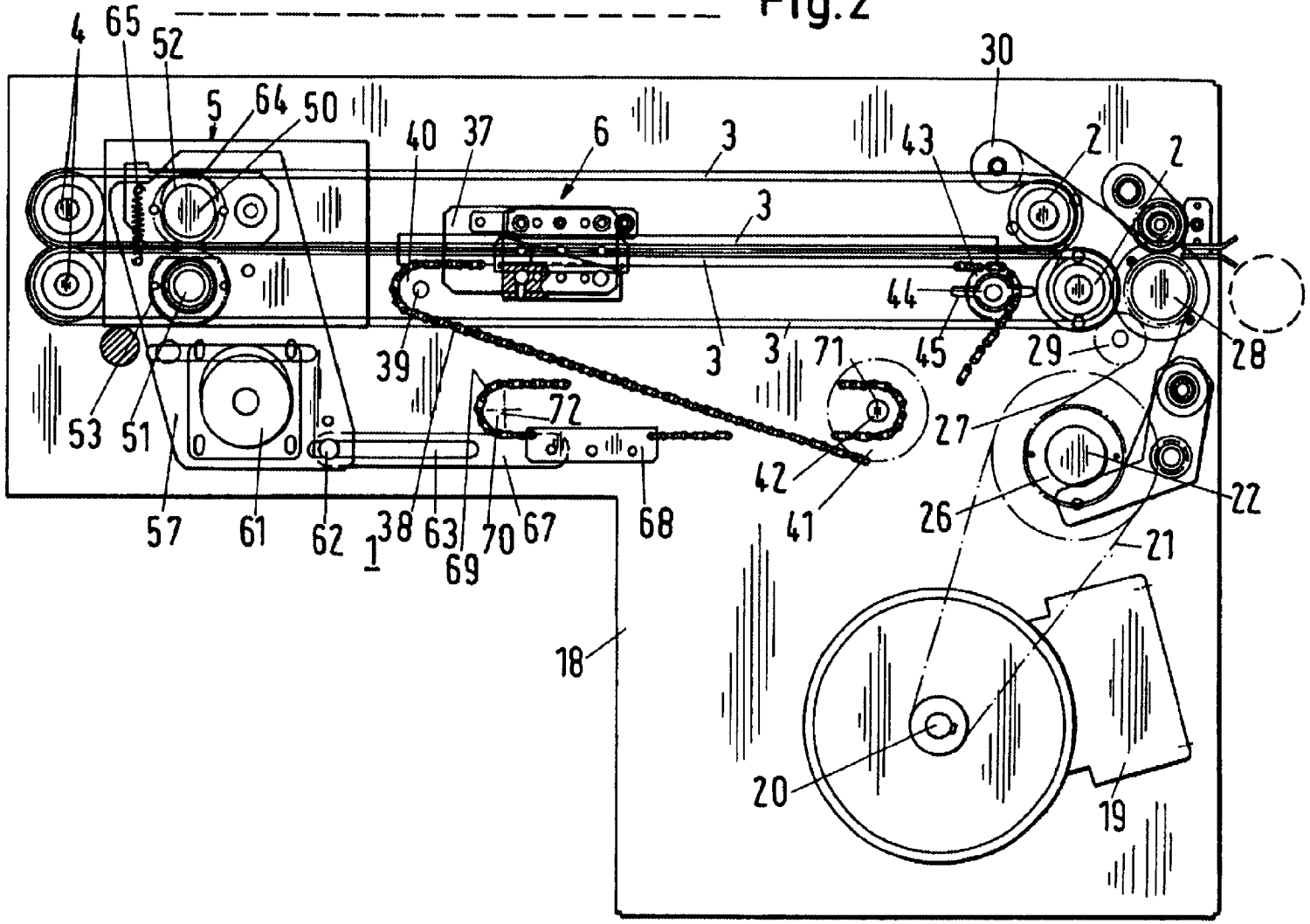
FIG. 2 is a side view of the device according to the invention.
Figure 3:
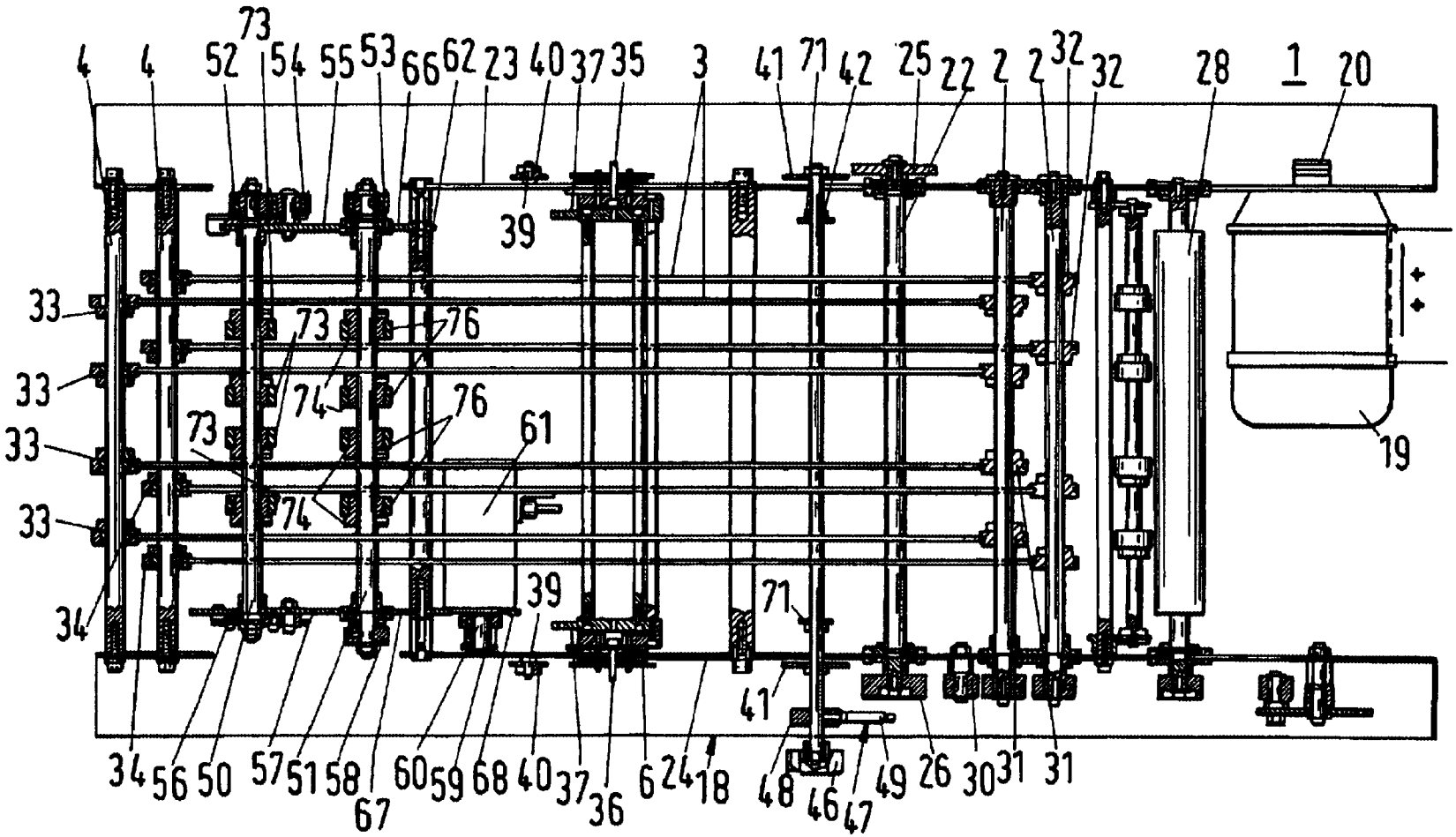
FIG. 3 is a plan view of the device according to FIG. 2, wherein, in order to simplify the drawing, parts that are positioned above one another are illustrated adjacent to one another.

As is illustrated in FIG. 2, the upper shaft 2 is positioned forwardly, relative to the lower shaft 2, in the transport direction of the sheets 9 to 11. However, this staggered placement is only so great that in a plan view onto the collector 1 the two shafts 2 do overlap one another.

Pulleys 31, 32 are fixedly connected to the two shafts 2 for common rotation and the endless transport belts 3 are guided about the pulleys 31, 32. The pulleys 31, 32 have an axial spacing to one another. The non-carrying run of the upper transport belts 3 and the carrying run of the lower transport belts 3 are arranged such that, viewed in the axial direction of the shafts 2, 4, they contact one another, and optionally overlap slightly. This ensures that even thin sheets can be transported reliably between the transport belts 3 of the collector 1. The axial spacing of the pulleys 31, 32 on the shafts 2 is so great that different sheet sizes can be reliably transported through the collector. The transport belts 3 are comprised advantageously of an elastic material and are formed as a round belt. The endless drive members 21, 27 provided for the drive action, on the other hand, are strip-shaped belts.

The upper transport belts 3 connect the upper shaft 2 with the upper shaft 4 which is provided with corresponding pulleys 33. Accordingly, the lower transport belts 3 connect the lower shaft 2 with the lower shaft 4 also having corresponding pulleys 34.

The axes of the two shafts 4, in contrast to the axes of the shafts 2, are positioned in a common vertical plane. The two ends of the shafts 4 are supported in the sidewalls 23, 24 of the frame 18.

The ramp 6 extends between the two sidewalls 23, 24 and is adjustable in the transport direction of the sheets 9 to 11. The sidewalls 23, 24 of the frame 18 are provided with slots extending in the transport direction. Axles 35, 36 provided at the end face of the ramp 6 project through the slots. As is illustrated in FIG. 2, the ramp 6 has at least on one end, preferably on both ends, brackets 37 extending parallel to the sidewalls 23 and 24 of the frame 18, wherein the brackets 37 are each engaged by an end of an endless circulating chain 38, respectively. When viewed in a side view (FIG. 2), the chains 38 are guided on chain wheels 40, fixedly seated on horizontal axles 39 for common rotation, to chain wheels 41, which are fixedly seated on a horizontal shaft 42 for common rotation, between the runs of the lower transport belts. The shaft 42 is in an area below the transport belts 3 and its ends are supported rotatably in the frame sidewalls 23, 24. The axles 39 are mounted in the sidewalls 23, 24 of the frame 18. The chain wheels 40, 41 are positioned on the outer sides of the frame sidewalls 23, 24 facing away from one another. The chains 38 extends from the chain wheels 41 to further chain wheels 43 which are seated on the shaft 44 between the two runs of the lower transport belts 3. Their two ends are supported in the frame sidewalls 23, 24. The shaft ends project through slots 45 provided in the frame sidewalls 23, 24 and extending in the transport direction of the sheets 9 to 11. The shaft 4 is secured in a suitable way relative to the frame sidewalls 23, 24 in a selected position. With a corresponding movement of the shaft 44 in the slots 45 the tension of the chains 38 can be adjusted by a desired amount. The chains 38 are fastened with their other ends on the brackets 37 of the ramp 6. As is shown in FIG. 3, one end of the shaft 42 is extended past the frame sidewall 24 and supports a manual actuator 46, preferably a turn wheel, with which the shaft 42 can be rotated about its axis. The shaft 42 is secured by clamping with a clamping device 47 provided on the frame in a selected rotational position. The clamping device 47 has a sleeve or bushing 48 provided on the frame 18 through which the shaft 42 projects. A clamping bolt 49 is screwed into the bushing 48 in a radial direction with which the shaft 42 can be securely clamped in the bushing 48 and thus relative to the frame 18.

For moving the ramp 6, it is possible to fasten rail-like strips on the inner sides of the frame sidewalls 23, 24 facing one another on which the carriage of the ramp 6 can be horizontally guided.

Also, the stop unit 5 can be adjusted in the transport direction of the sheets 9 to 11 in order to adjust the collector 1 to different papers sizes. The stop unit 5 has two shafts 50, 51 positioned atop one another and arranged at the same level as the neighboring shafts 4. They extend between the runs of the upper and the lower transport belts 3. The two shafts 50, 51 engage one another at their ends in the vicinity of the frame sidewall 23 by respective gear wheels 52, 53. The gear wheel 52 seated on the shaft 50 meshes also with a gear wheel 54 which is supported rotatably in a support plate 55 through which the one ends of the shaft 50, 51 extend and in which they are rotatably supported.

At the other end neighboring the frame sidewall 24, the shaft 50 is rotatable supported by means of a bearing 56 in the support plate 57. The lower shaft 51 extends through this support plate 57 and supports on its projecting end a pulley 58 which is in driving connection by means of a drive belt (not shown) with a pulley 60 mounted on a motor shaft 59. The motor 61 for driving the shafts 50, 51 of the stop unit 5 is fastened on the support plate 57 which extends, like the oppositely positioned support plate 55, in a vertical plane. As is illustrated in FIG. 2, the support plate 57 projects downwardly past the transport belt 3. The motor 61 is fastened in the area below the transport belt 3 on the support plate 57 on the side facing away from the frame sidewall 24. At the lower edge the oppositely positioned support plates 55, 57 are connected by an axle 62 to one another. The axle 62 extends with its ends through the support plates 55, 57 and engages horizontal slots 63 in the frame sidewalls 23, 24. The two support plates 55, 57 are also supported with the oppositely positioned edge area on the frame.

The upper shaft 50 is spring-loaded toward the lower shaft 51 so that it can be radially moved relative to the shaft 51 to a limited extent. This is necessary when the sheet stack to be transported has a greater thickness. In order to ensure this movability, the openings 64 in the support plates 55, 57 are wider than the shaft 50. The ends of the shaft 50 are received in a sleeve which projects through the openings 64. A tension spring 65 is connected to a radial projection of these sleeves (bushings), respectively, and the end of the spring is fastened to the support plate 55 or 57.

The support plates 55, 57 are provided at their lower edge with a respective projection 66, 67 extending counter to the transport direction 16 through which the ends of the axle 62 project. The projections 66, 67 are bracket-shaped (FIG. 2) and are positioned in the area between the two frame sidewalls 23, 24. At the free end of the projection 67 a bracket 68 is mounted on which the two ends of the circulating chain 69 are fastened (FIG. 2). The chain 69 is guided about two chain wheels 70, 71 on a shaft 72 and a shaft 42. While the chain wheels 41 are positioned external to the frame 18 (FIG. 3), the chain wheels 71 are positioned within the frame 18. The two chain wheels 70, 71 have the same diameter which is smaller than the diameter of the chain wheels 41 on the shaft 42 via which the chains 38 for adjusting the ramp 6 are guided. The diameter of the chain wheels 41 and 71 on the shaft 42 are selected such that during rotation of the shaft 42 the ramp 6 is adjusted by a distance twice that of the displacement of the stop unit 5. In this way, the stop unit 5 and the ramp 6 are adjusted simultaneously with one adjusting process to the desired paper size. For rotation of the shaft 42 it is only required that the clamping bolt 49 be unscrewed such that the shaft 42 can be freely rotated in the bushing 48. With the manual actuator 46 the shaft 42 can then be rotated by the desired amount wherein via the described chain drive the stop unit 5 and the ramp 6 are adjusted simultaneously in the same direction. Subsequently, the clamping bolt 49 is again tightened and the shaft 42 is then fixedly clamped in the bushing 48.

Rollers 73, 74 are positioned fixedly for common rotation on the two shaft 50, 51 of the stop unit 5. They have an axial spacing to one another and are advantageously provided on their periphery with friction coatings 75, 76. The rollers 73, 74 are resting against one another via these coatings by the force of tension springs 65. The rollers 73, 74, as can be seen in the plan view according to FIG. 3, are arranged in the area between the transport belts 3.

When adjusting the stop unit 5, the axle 62 with its two ends is moved in the slots 63 extending in the transport direction 16. The support plates 55, 57 are also guided at the oppositely positioned edge in a suitable way on the frame. The ramp 6 is guided in the described manner on the frame sidewalls 23, 24 during movement so that a problem-free adjustment of these components of the collector 1 is ensured.

The photoelectric barrier 14 in the area of the ramp 6 triggers in the way disclosed above the working cycle for the two shafts 50, 51 of the stop unit 5. As soon as the respective following sheet 10,11 has passed the photoelectric barrier 14, the motor 61 receives a corresponding activation signal so that the shafts 50, 51 are rotated and their rollers 73, 74 transport the sheet 9 or set of sheets resting against the stop unit 5 to the after processing unit 12. The light barrier 13 arranged in the transport direction downstream of the shafts 4 provides an additional safety feature because it allows monitoring of the set separation. In this way, it is ensured that the individual sets, which may be comprised of a single or of several sheets, are checked and supplied precisely separated from one another to the after processing unit 12.

While specific embodiments of the invention have been shown and described in detail to illustrate the inventive principles, it will be understood that the invention may be embodied otherwise without departing from such principles.

What is claimed is:

1. A method for transporting sheets, said method comprising the steps of:

conveying individual sheets successively in a conveying direction to a stop unit and holding at least one sheet at the stop unit to form a set at the stop unit;

activating the stop unit for conveying the set formed at the stop unit when a sheet of a next stack to be formed at the stop unit overlaps the stack formed at the stop unit;

guiding each sheet on a path to the stop unit across at least one ramp.

2. The method according to claim 1, wherein the ramp is positioned at a spacing upstream of the stop unit in the conveying direction, wherein the spacing matches an individual sheet length of the sheets in the conveying direction.

3. The method according to claim 1, further comprising the step of feeding the sheets by a supply system to a conveying device for conveying the sheets to the stop unit.

4. The method according to claim 3, comprising the step of continuously operating the supply system.

5. A method for transporting sheets, said method comprising the steps of:

conveying individual sheets successively in a conveying direction to a stop unit and holding at least one sheet at the stop unit to form a set at the stop unit;

activating the stop unit for conveying the set formed at the stop unit when a sheet of a next stack to be formed at the stop unit overlaps the stack formed at the stop unit;

wherein the set formed at the stop unit and the sheet of the next set to be formed are simultaneously conveyed once the stop unit is activated for further conveying of the set formed at the stop unit.

6. A device for transporting sheets by conveying individual sheets successively in a conveying direction to a stop unit and holding at least one sheet at the stop unit to form a set at the stop unit and activating the stop unit for conveying the set formed at the stop unit when a sheet of a next stack to be formed at the stop unit overlaps the stack formed at the stop unit, said device comprising:

a collector comprising transport elements configured to transport sheets along a transport path and a stop unit positioned in said transport path and configured to be operated intermittently for forming sets of sheets and further transporting the sets formed thereat;

a control device connected to said stop unit;

said collector further comprising a first sensor device connected to said control device and configured to send an activation signal to said stop unit when a sheet of a next set to be formed overlaps a set already formed at the stop unit; and at least one ramp positioned in said transport path upstream of said stop unit, said ramp configured to briefly lift the sheets out of a plane of transport during transport of the sheets to said stop unit.

7. The device according to claim 6, wherein said ramp has a spacing from said stop unit and wherein said spacing matches a sheet length of the sheets in said transport direction.

8. The device according to claim 6, wherein said ramp is configured to lift each successive sheet such that the successive sheet is lifted above the set positioned in front of said stop unit.

9. The device according to claim 6, wherein said ramp is adjustable in said transport direction.

10. The device according to claim 6, wherein said stop unit is adjustable in said transport direction.

11. The device according to claim 6, further comprising a common adjusting drive connected to said stop unit and said ramp, wherein said ramp is adjustable in said transport direction and wherein said stop unit is adjustable in said transport direction by said common adjusting drive.

12. The device according to claim 11, wherein said adjusting drive comprises two endless drive members.

13. The device according to claim 12, wherein said adjusting drive has a common drive shaft and wherein said endless drive members are configured to be driven by said common drive shaft.

14. The device according to claim 11, wherein an adjusting stroke of said stop unit and an adjusting stroke of said ramp have a ratio of 1:2.

15. The device according to claim 6, further comprising at least one supply system positioned upstream of said transport elements and configured to operate continuously.

16. The device according to claim 6, wherein said control device comprises at least one micro controller.

17. The device according to claim 16, wherein said micro controller is configured to be arranged in said collector, in a supply device upstream of said collector, or in an after processing device downstream of said collector.

18. The device according to claim 6, wherein said transport elements comprise transport belts.

19. A device for transporting sheets by conveying individual sheets successively in a conveying direction to a stop unit and holding at least one sheet at the stop unit to form a set at the stop unit and activating the stop unit for conveying the set formed at the stop unit when a sheet of a next stack to be formed at the stop unit overlaps the stack formed at the stop unit, said device comprising:

a collector comprising transport elements configured to transport sheets along a transport path and a stop unit positioned in said transport path and configured to be operated intermittently for forming sets of sheets and further transporting the sets formed thereat;

a control device connected to said stop unit;

said collector further comprising a first sensor device connected to said control device and configured to send an activation signal to said stop unit when a sheet of a next set to be formed overlaps a set already formed at the stop unit;

wherein said stop unit comprises parallel shafts and rollers mounted on said shafts, wherein said rollers are in a contact position in which said rollers touch one another.

20. The device according to claim 19, wherein said rollers are configured to be force-loaded into said contact position.

21. The device according to claim 19, wherein said rollers on a first one of said shafts are radially moveable to a limited extent relative to said rollers on a second one of said shafts.

22. The device according to claim 21, wherein said first shaft with said rollers is radially moveable to a limited extent relative to said second shaft with said rollers.

23. A device for transporting sheets by conveying individual sheets successively in a conveying direction to a stop unit and holding at least one sheet at the stop unit to form a set at the stop unit and activating the stop unit for conveying the set formed at the stop unit when a sheet of a next stack to be formed at the stop unit overlaps the stack formed at the stop unit, said device comprising:

a collector comprising transport elements configured to transport sheets along a transport path and a stop unit positioned in said transport path and configured to be operated intermittently for forming sets of sheets and further transporting the sets formed thereat;

a control device connected to said stop unit;

said collector further comprising a first sensor device connected to said control device and configured to send an activation signal to said stop unit when a sheet of a next set to be formed overlaps a set already formed at the stop unit;

at least one supply system positioned upstream of said transport elements and configured to operate continuously;

at least one reading device arranged between said supply system and said transport elements.

24. A device for transporting sheets by conveying individual sheets successively in a conveying direction to a stop unit and holding at least one sheet at the stop unit to form a set at the stop unit and activating the stop unit for conveying the set formed at the stop unit when a sheet of a next stack to be formed at the stop unit overlaps the stack formed at the stop unit said device comprising:

a collector comprising transport elements configured to transport sheets along a transport path and a stop unit positioned in said transport path and configured to be operated intermittently for forming sets of sheets and further transporting the sets formed thereat;

a control device connected to said stop unit;

said collector further comprising a first sensor device connected to said control device and configured to send an activation signal to said stop unit when a sheet of a next set to be formed overlaps a set already formed at the stop unit;

at least one second sensor device positioned in said transport direction downstream of said stop unit, wherein said second sensor device is configured to monitor separation of the sets.

* * * * *